United States Patent [19]

Stalzer

[11] 3,948,074

[45] Apr. 6, 1976

[54] COMBINATION CLEAT BENDER AND BAR FOLDER APPARATUS

[75] Inventor: Leo Henry Stalzer, Chicago, Ill.

[73] Assignee: Lion Services, Inc., LaGrange Park, Ill.

[22] Filed: Dec. 9, 1974

[21] Appl. No.: 530,646

[52] U.S. Cl. ..... 72/312; 72/319; 72/381; 72/411

[51] Int. Cl.[2] ..... B21D 11/04; B21D 5/04

[58] Field of Search ..... 72/321, 312, 411, 319, 72/381, 469, 320

[56] References Cited

UNITED STATES PATENTS

| | | | |
|---|---|---|---|
| 1,192,797 | 7/1916 | Salmon | 72/320 |
| 1,408,106 | 2/1922 | McCabe | 72/319 |
| 3,161,223 | 12/1964 | Marsh | 72/319 |
| 3,662,584 | 5/1972 | Jones | 72/411 |
| 3,786,666 | 1/1974 | York | 72/320 |

*Primary Examiner*—C. W. Lanham
*Assistant Examiner*—E. M. Combs
*Attorney, Agent, or Firm*—Neuman, Williams, Anderson & Olson

[57] ABSTRACT

A sheet metal bending brake apparatus adapted to make complex bends in a sheet metal workpiece, comprising a frame, a fixed holding bar mounted adjacent of said surface, a movable holding bar mounted on said frame movable between a forward clamping position in opposed clamping relationship with the fixed bar and a rearward and downward position below the plane of the fixed surface, a bending brake element adjacent the fixed jaw adapted to contact sheet metal held between the same, said bending element adapted to rotate 180°, or more, around a point adjacent the jaws, the movable holding bar being coordinated with the bending brake to release from the holding position before the bending brake has rotated 180°.

4 Claims, 20 Drawing Figures

FIG. 8
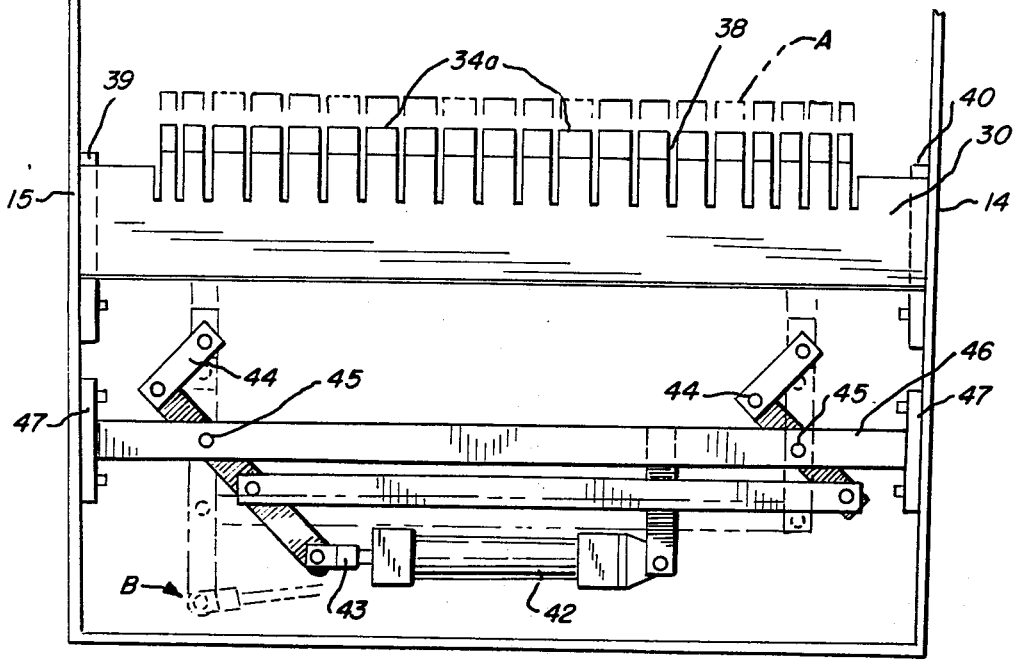
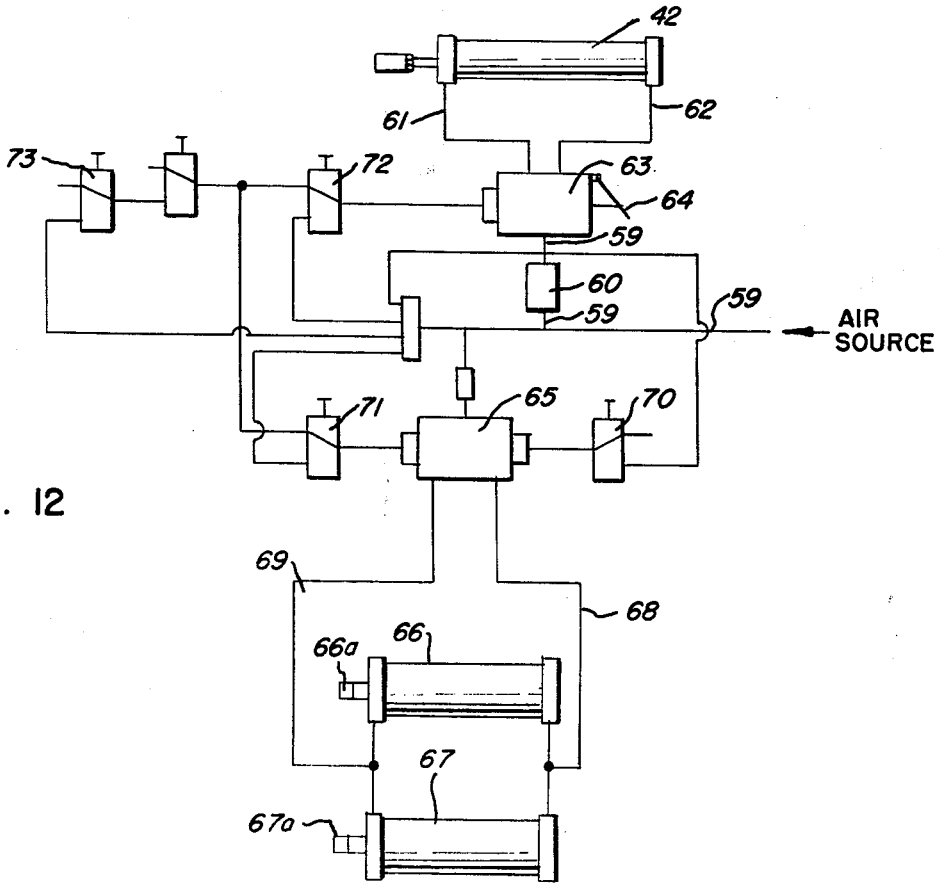
FIG. 12

COMBINATION CLEAT BENDER AND BAR FOLDER APPARATUS

BACKGROUND OF THE INVENTION

1. Field of the Invention

This invention relates to bending brakes and more particularly to a combination cleat bender and bar folder apparatus.

2. Description of the Prior Art

The bending brake devices of the prior art are, in general, adapted to form sheet metal into a variety of shapes by a series of bending or folding operations. The simplest form of apparatus involves a pair of clamping jaws to secure a sheet metal workpiece and a bending brake adjacent the clamping means or jaws which is adapted to contact a portion of the sheet metal protruding therefrom to rotate the metal in a bending action around a pivot point adjacent the terminus of the jaws. The conventional apparatus of the prior art is so constructed so that the bend achieved is usually no greater than 90°, or in other words, essentially a right angle bend, which may be exemplified by U.S. Pat. No. 3,380,280 issued to Wise on Apr. 30, 1968. This patent discloses a pair of spaced apart, rigid frame members, one of which carries a brake platen securely fastened thereto and the other having a clamping table mounted thereon. The table is adapted to move between an open position relative to the braking platen and a closed or clamping position. The table also carries an elongated brake bar and a hinge means supporting the brake bar on the table for pivotal movement about an axis substantially coextensive with the fixed braking edge when the table is in the braking position. The apparatus, while capable of making 90° bends, is not capable of making 180° bends since the bending action of the brake bar is limited by the shape of the forward edge of the brake platen which holds the sheet metal workpiece.

More complex cleat benders may be exemplified by U.S. Pat. No. 3,731,514, patented on May 8, 1973. This patent discloses a cleat bender and a pair of punch means traveling at substantially right angles to each other, adapted to form the metal into a U-shaped configuration around the free end of the forming die which is an integral part of the table surface. The U-shaped configuration is achieved by making essentially two spaced apart 90° bends on separated portions of the workpiece by folding the same around a square-ended die.

Summer, U.S. Pat. No. 3,552,176, patented Jan. 5, 1971, discloses an apparatus for folding the end portion of a metal sheet to a somewhat larger angle than 90°, preferably an angle in excess of 135°. The apparatus including a single folding rail which has a nose portion and an inclined surface portion. The movement of these elements is so controlled that the nose portion folds the sheet metal end by 90° and subsequently the inclined surface portion additionally folds the thus folded end portion beyond 90° to the desired folding angle. The second folding action takes place by movement of the folding rail against a surface of the lower holding jaw which inclines rearwardly from the first folding edge wherein the 90° bend is formed. The angle of the fold is limited by the necessary structure of the lower jaw to achieve the strength necessary to form a supporting surface. Neither Summer nor any of the other prior art apparatuses are capable of forming a bend in sheet metal which is 180° or more. Moreover, most of the prior art constructions are not adapted to form combination bends or complex shapes on the bending machine. Furthermore, the apparatuses of the prior art were incapable of forming complex bends on structures such as ducts which are not in the flat sheet form.

SUMMARY OF THE INVENTION

The present invention relates to a bending brake apparatus, and more particularly, to a combination cleat bender and bar folder capable of forming 180°, or more than 180°, and other complex bends in flat or partially formed sheet metal stock.

The apparatus comprises a frame, including a fixed supporting table surface carried thereby, a fixed holding bar jaw mounted adjacent one edge of said support surface, a movable support section and holding bar movably mounted adjacent said one edge of the fixed support surface provided with a jaw having a tapered folding edge which has a plurality of regularly spaced slots formed therein, and a bending brake element pivotally mounted adjacent and rearwardly of the fixed and movable holding bar elements adapted to pivot around a fixed point adjacent the fixed and movable holding bar elements to bend a sheet metal workpiece held therebetween, and means adopted to withdraw the movable holding bar element after the bending brake has rotated more than 90° from the plane established by the surface of the support table and upper surface of the movable jaw and support element. The fixed bending bar and the bending brake are also provided with a plurality of slots formed therein which extend from the one edge thereof. The slots in the fixed holding bar and the bending brake are all spaced at similar complementary intervals to match up with each other during operation of the apparatus.

BRIEF DESCRIPTION OF THE DRAWINGS

Reference is made to the attached drawings wherein:

FIG. 8 is a partial top view of the apparatus of the present invention with the top support surface removed to show the assembly and mounting of the movable holding bar and support element;

FIG. 12 is a schematic piping diagram of the apparatus of the present invention;

DETAILED DESCRIPTION OF THE PREFERRED EMBODIMENTS

Figure 1:
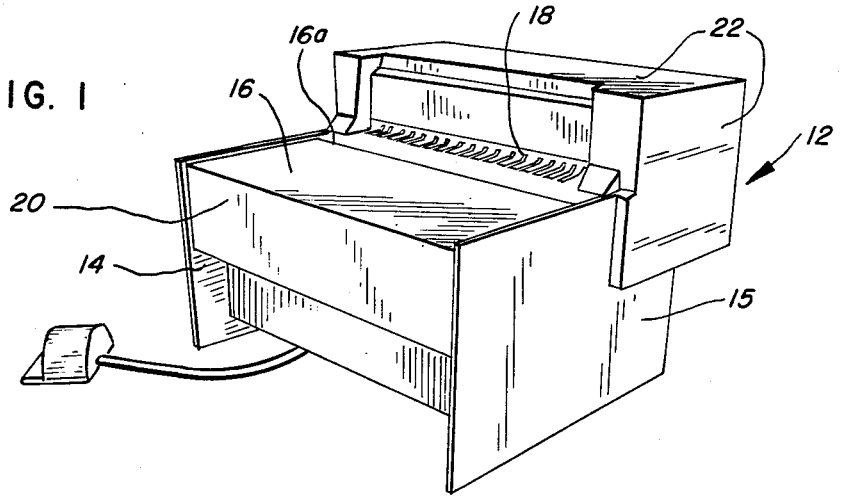
FIG. 1 is a perspective view of the bending apparatus of this invention.

Referring to the drawings, there is illustrated a bending brake or combination cleat bender and bar forming apparatus 12 comprising a pair of supporting side wall and frame members 14 and 15, and a generally rectangular fixed top or support surface 16 which extends between the side frame members 14 and 15 and extends rearwardly from the front panel 20 to a rear edge 16*a*. The side frame members 14 and 15, front panel 20 and rear panel (not shown) form a base or support for the machine. A top housing 22 extends upwardly and rearwardly from the rear portion of the base. A fixed holding bar or hold-down jaw element 18 is shown, mounted adjacent the rear edge 16a of the support surface 16. The hold-down bar 18 has an elongated, vertically disposed, rectangular back element 24 and a forwardly angled jaw element 26 terminating in a securing jaw surface 26*a* which is generally parallel to the plane established by top 16 and spaced slightly above and rearwardly of the rear edge thereof, 16*a*.

Figure 10:
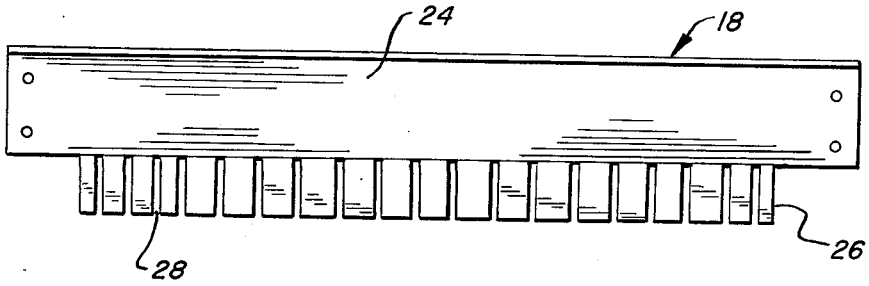
FIG. 10 is a top plan view of the fixed holding bar element of the apparatus of the present invention.
Figure 9:
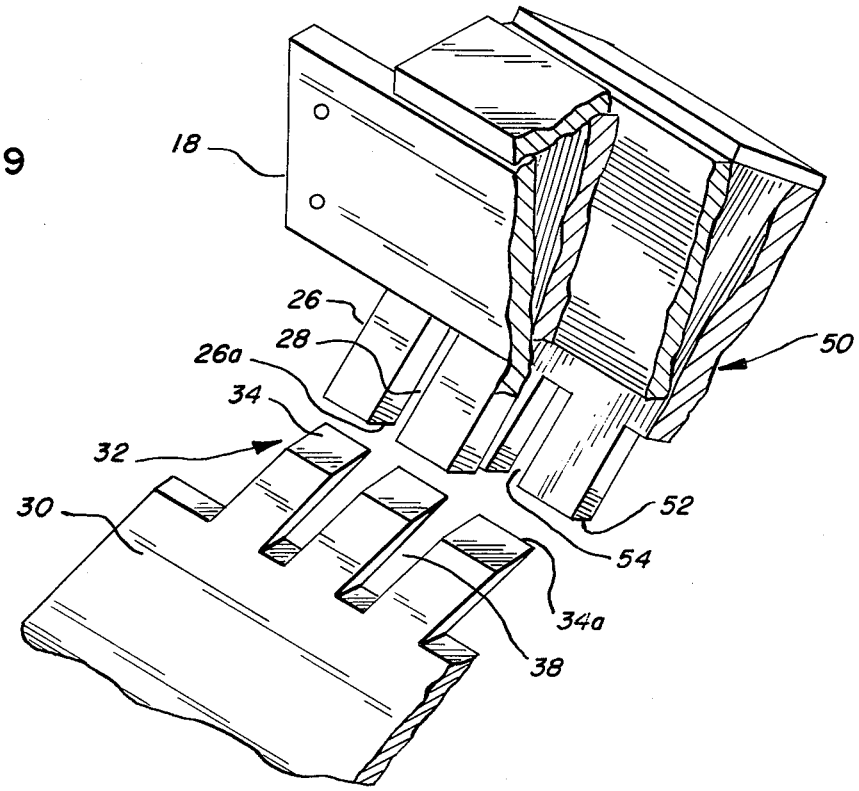
FIG. 9 is a fragmentary perspective view in partial section of the apparatus of the present invention showing the assembly relationship between the movable holding bar, fixed holding bar element and bending brake.

As shown in FIGS. 9 and 10, the holding bar 18 is provided with a plurality of slots 28 to form a plurality of finger members in the jaw element 26.

Figure 2:
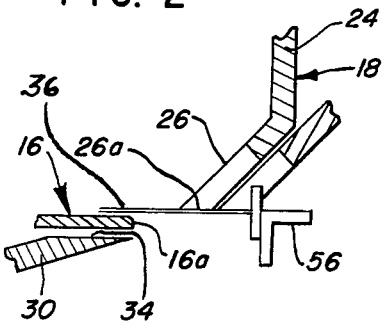
FIGS. 2 through 7 are partial fragmentary crosssectional views showing a sequence of steps involved in bending a sheet metal workpiece using the apparatus of the present invention.
Figure 3:
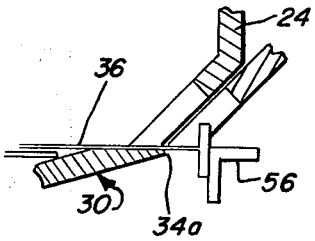

A movable holding bar 30 is shown in FIGS. 8 and 9 and schematically and partially in FIGS. 2–7. Holding bar 30 is provided with a tapered forward portion 32 and has a jaw or holding surface 34 which is engageable with the surface 26*a* of fixed holding bar 18 when the bar 30 is in the forward position. (See FIG. 3). In operation, movable holding bar 30 moves forwardly to secure a sheet metal workpiece 36 as shown in FIG. 3 and jaw surface 34 presses the bottom of the sheet 36 upwardly against the jaw surface 26*a* of fixed bar 18. As shown in FIG. 9, the movable bar 30 has a plurality of slots 38 formed in the tapered forward portion 32 which are complementary and match up with the slots 28 in the fixed holding bar 18. The tapered series of edges 34*a* of jaw 34 define a bending edge around which sheet metal is bent in a folding or cleat forming operation.

As shown in FIG. 8, the movable bar 30 is positionable between a forward or metal workpiece engaging position as shown by the dotted lines in FIG. 8 and labeled "A". This corresponds to the position shown in FIGS. 3 and 4 of the drawings. The solid line drawing is of the bar 30 in the withdrawn or open or retracted position and is illustrated by the positions shown in FIGS. 2 and 5–7 of the drawings. Bar 30 is mounted parallel to the side frame walls 14 and 15, adjacent top 16 on a pair of slide plates 39 and 40 which are bolted or otherwise secured to walls 14 and 15. The slides 39 and 40 are angled slightly to incline upwardly toward the rear of the apparatus so that bar 30, when fully forward, forms an extension of surface 16 with its jaw surfaces 34 which, when bar 30 is in the clamping or closed and forward position, is essentially parallel to the surface of table or support surface 16.

Figure 18:
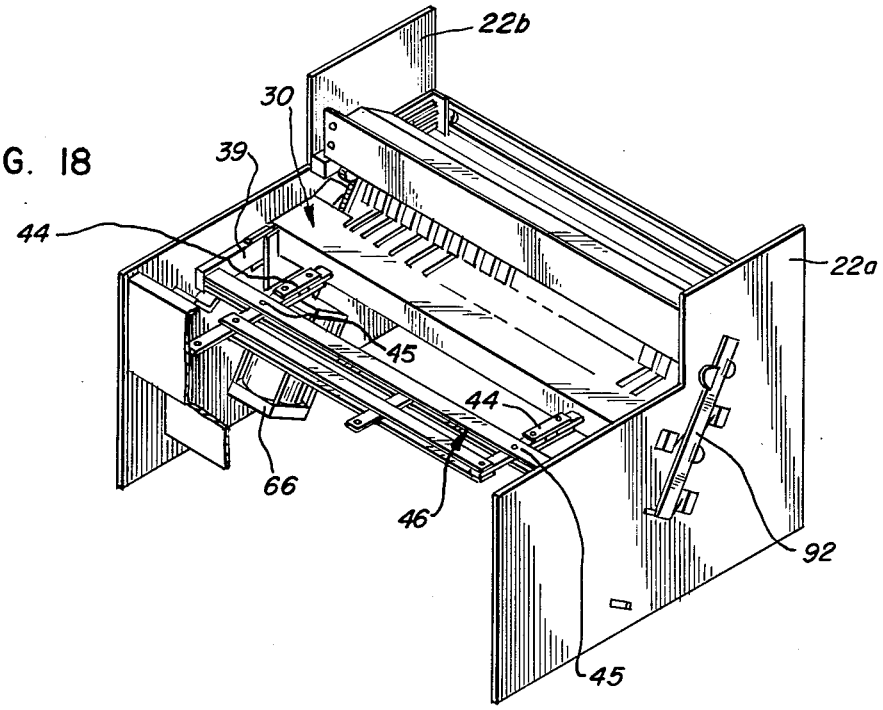
FIG. 18 is a perspective view of the assembled elements of FIG. 17.

Bar 30 is driven forward by air piston 42 which acts by mechanical linkages 44 pivoted at 45 on cross bar 46 secured at its ends 47 to frame side walls 14 and 15. When piston drive arm 43 of piston 42 is driven out as shown in the dotted line position designated B, bar 30 advances to position A, as also shown in FIG. 18.

Figure 11:
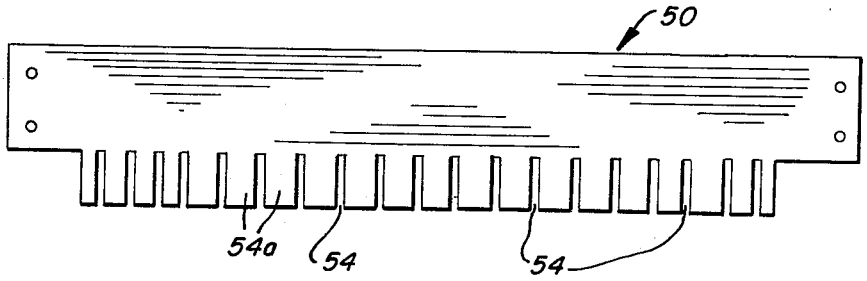
FIG. 11 is a top plan view of the bending brake element of the apparatus of the invention.

As shown in FIG. 9, there is also provided a bending bar or brake element 50 which is pivotally mounted on frame members 22*a* and 22*b* which form part of extension 22 immediately behind holding bar 30. Bending brake 50, also shown in top plan view of FIG. 11 is provided with a bending jaw surface 52 which, as shown in FIG. 9, is essentially parallel to jaw surface 26*a* of bar 18 when movable bar 30 is in the open and withdrawn position shown in FIG. 2 and in the closed or metal workpiece clamping position shown in FIG. 3 prior to bending. Brake 50 is similarly provided with a plurality of slots 54 which are spaced to match the slots 28 and 38 in elements 18 and 30. The pivotal or bending movement of bending brake 50 is illustrated in FIGS. 4–7 of the drawings.

The total bending operation sequence is illustrated in FIGS. 2–7. In FIG. 2 a metal workpiece or sheet 36 is placed on surface 16 and pushed forward under the jaw 26 of element holding bar 18 until it meets movable stop 56 which is spaced rearwardly of brake bar 50.

Figure 4:
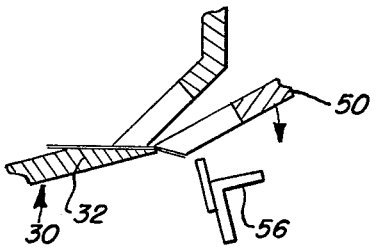
Figure 5:
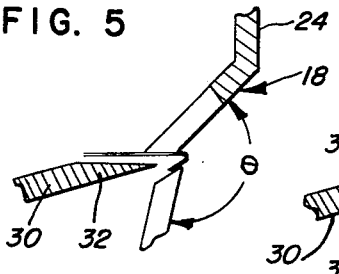

Movable holding bar 30 is moved forward by actuation of the machine, and jaw surface 34 moves upwardly to engage sheet 36 as shown in FIG. 3 and clamp sheet 36 between its jaw surface 34 and jaw surface 26*a* of jaw 26. In FIG. 4 the brake 50 begins its rotational sequence, bending the metal sheet 36 around nose 34a of bar 30. At the same time, stop 56 drops away from beneath bar 50. When bar 50 has rotated through the angle $\theta$ shown in FIG. 5, jaw 30 is coordinated to begin its withdrawal. Usually the point at which holding bar 30 is withdrawn is about 25° before bar 50 has rotated 180° or, alternatively, when angle $\theta$ is about 155° or more.

Figure 6:
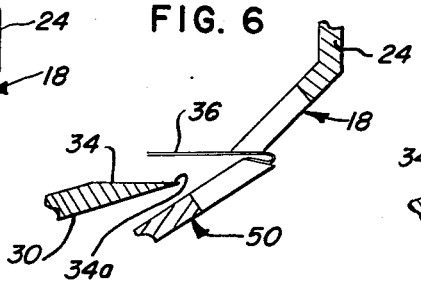
Figure 7:
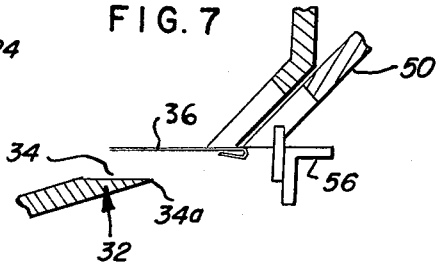

FIG. 6 shows the total withdrawal of jaw 30 and the completion of the bend in sheet 36 to 180° and more by bar 50 and FIG. 7 the return of bending brake 50 and stop 56 to their original positions just prior to withdrawal of the sheet 36 with the bend completed.

The schematic diagram of the pneumatic drive system for the apparatus of the present invention is illustrated in FIG. 12. Cylinder 42 is a pneumatic cylinder actuated by air pressure from source fed through lines 59. Check valve 60 and lines 61 and 62 are controlled by foot valve 63. Actuation of foot pedal 64 causes air to flow into cylinder 42 from valve 63 and causes table sector or jaw 30 to advance (see FIG. 3). Valve 65 is the main control valve for air pressure which is a source of energy for bend cylinders 66 and 67 which drive the bending brake 50 by action of the pistons 66*a* and 67*a*. Conduits 68 and 69 feed air from bend valve 65, bend valve 65 being actuated by switch 70 which goes into operation when jaw 30 closes. When the bend is completed, brake 50 actuates switch 71 which causes the bend cylinders to retreat and at the same time actuates switch 72 which causes jaw 30 to retreat. Switch 73 is an auxiliary variable bend valve which, when actuated or preset, causes the bend completion valve to open when the bending brake has rotated and bend a metal workpiece to the predetermined angle-set position.

Figure 17:
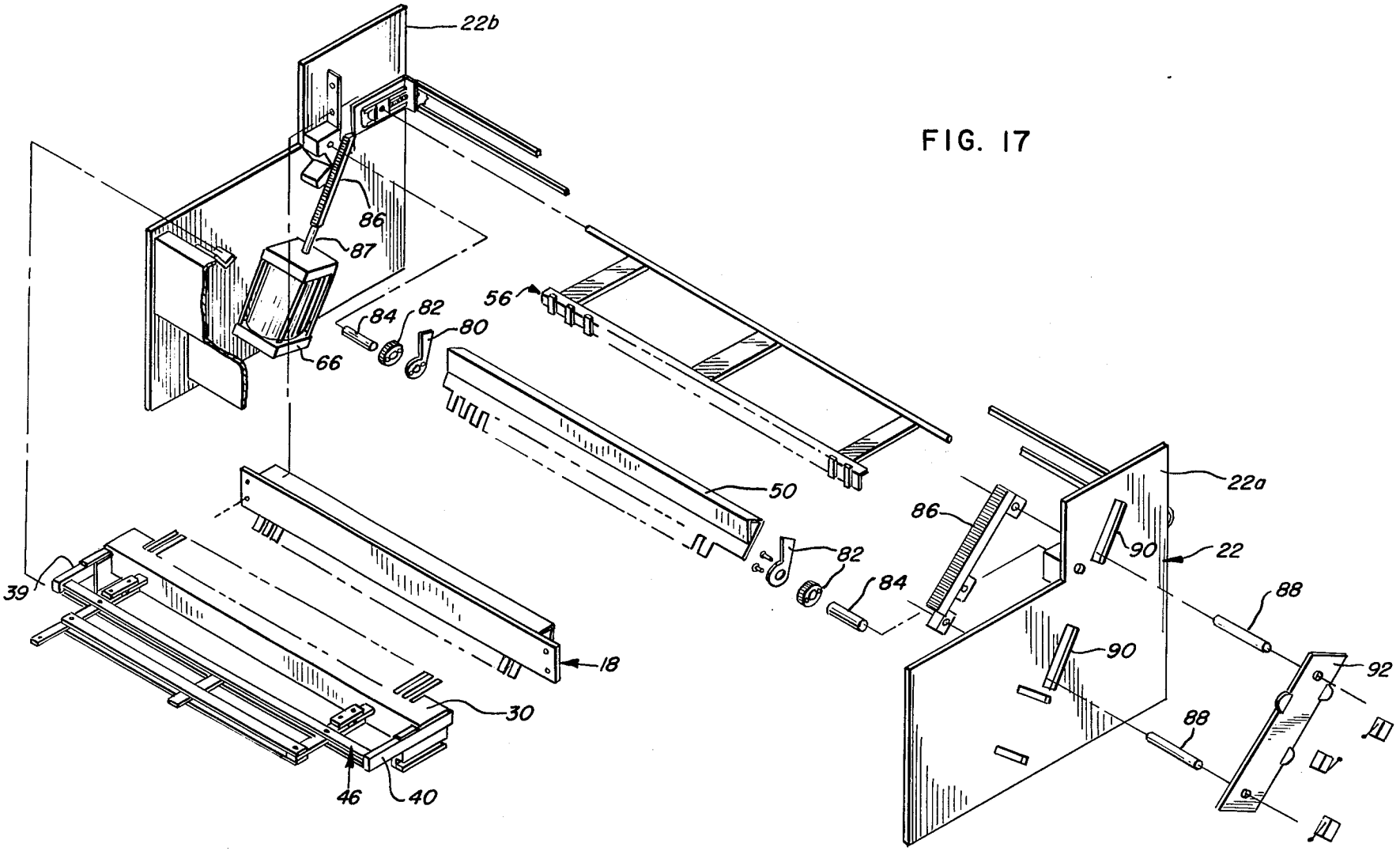
FIG. 17 is an exploded view of the apparatus of the present invention.
Figure 19:
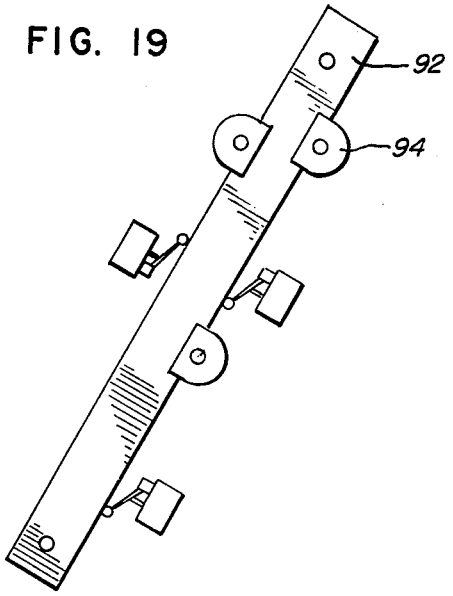
FIG. 19 is a side view of the control bar.

Reference is made to FIGS. 17 and 18 which represent respectively exploded and assembled perspective views of the apparatus of the present invention. As shown, the bending bar 50 has affixed to end brackets 80, spur pinion gears 82 and pivot axles 84. The rotation of bending bar 50 on pivot axles 84 is provided by the movement of toothed racks 86 which are mounted for reciprocating movement on piston drives 87 of pneumatic cylinders 66 and 67. The length of the rack 86 and the circumference of the spurred pinion gear 82 are such as to permit drive of the bar 50 through an angle of 180° or more. Rod-like extensions 88 are affixed to one of the racks and extend through slots 90 provided in wall 22a and to valve control bar 92 (also shown in FIGS. 18 and 19) which is provided with a series of movable valve trip cams 94 which control valve switches 71–73 which control the withdrawal of holding jaw 30, the degree of bend and return of bar 50 to its original position.

Figure 20:
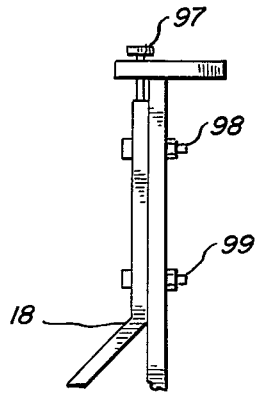
FIG. 20 is an end view of an adjustment feature.

FIG. 20 is a schematic side view in partial section of the hold-down bar 18 adjustment provided by movement of adjustment screw 97 and loosening screws 98 and 99. This permits adjustment of the tightness of the bend by regulating the spacing between jaw face *26a* and jaw face 52.

Figure 13:
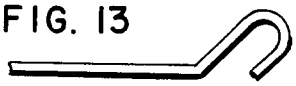
FIGS. 13 through 16 are partial end views of the types of sheet metal bends that can be made by the apparatus of the invention.
Figure 14:
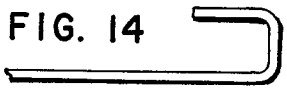
Figure 15:
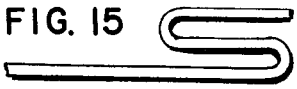
Figure 16:
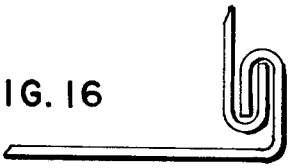

The slotted nature of the jaws and bending brake permit more versatile employment of the bending brake apparatus of the present invention, permitting bends of great variety on already formed sheets. Bends such as those shown in FIGS. 13–16 may be readily produced by adjustment of the cam stops 94 on control bar 92. For example, the bend of FIG. 13 may be made by first making a 180° bend in the end of a sheet of metal but adjusting the tightness of bend to just short of complete closure. The bent end is then inserted into the apparatus which is set for less than a 180° bend at a point short of the end of the fold already formed.

I claim:

1. A sheet metal bending brake apparatus comprising:

a. a frame;

b. a generally rectangular work supporting surface mounted on said frame;

c. a fixed holding bar mounted on said frame adjacent the rear edge of said support surface and extending laterally and upwardly substantially coextensive therewith, said bar comprising a generally vertical element extending across the front width of the frame and a forwardly, downwardly, angularly extending element having a plurality of slots formed therein so as to comprise discrete finger members upwardly unobstructed by the frame, said angularly extending element terminating in a plurality of securing jaw surfaces that are disposed forward of the plane of the vertical element, said securing surfaces being generally parallel to said support surface and spaced slightly above and rearwardly of the rear edge of said support surface;

d. a movable holding bar mounted on said frame adjacent said rear edge of the support surface movable between a rearwardly and upwardly clamping position in opposed clamping relationship to the fixed bar and substantially parallel to the support surface and a position forwardly and downwardly of the support surface; and e. a bending brake element mounted on said frame rearwardly of said holding bars, said element having an uppermost surface substantially parallel to the uppermost surface of the vertical element of said fixed holding bar, said element extending rearwardly and downwardly therefrom, said element comprising a bending jaw surface essentially parallel to the securing jaw surfaces of said fixed holding bar, said bending jaw surface adapted to contact a sheet metal workpiece held between said holding bars and rotate around an axis adjacent and rearwardly of the jaws of the holding bars in the closed position, the movable holding bar being coordinated with the movement of the bending brake element to release from the holding position prior to the point when the bending brake has rotated 180°, said movable holding bar and bending brake element being formed with a plurality of slots complementary to the slots formed in the fixed holding bar.

2. An apparatus according to claim 1 wherein movable stop means are provided which may be spaced at a pre-determined distance from the end of said movable holding bar, said stop means being positioned slightly rearwardly and downwardly from the bending jaw surface of said bending brake element, said means being adapted to rotate rearwardly and downwardly about an axis rearwardly of said brake element, the stop means being coordinated with the movement of the brake element such that the stop means drop away from beneath said brake element when said element begins its rotational sequence.

3. An apparatus according to claim 1 wherein movable valve trip cam means are provided to actuate fixed control valve switch means to adjust the degree of rotation of the bending brake means.

4. An apparatus according to claim 1 wherein adjustment means are provided to regulate the tightness of bend in a sheet metal workpiece.

* * * * *